US006305773B1

(12) United States Patent
Burr et al.

(10) Patent No.: US 6,305,773 B1
(45) Date of Patent: Oct. 23, 2001

(54) APPARATUS AND METHOD FOR DROP SIZE MODULATED INK JET PRINTING

(75) Inventors: Ronald F. Burr, Wilsonville; Eric C. Segerstrom, Portland; Christine M. Greb, Lake Oswego; John M. Wiltse, Portland, all of OR (US); Joseph D. Hart, Vancouver, WA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/124,636

(22) Filed: Jul. 29, 1998

(51) Int. Cl.[7] ..... B41J 29/38; B41J 2/045
(52) U.S. Cl. ..... 347/11; 347/10; 347/68
(58) Field of Search ..... 347/9, 10, 11

(56) References Cited

U.S. PATENT DOCUMENTS

| | | | |
|---|---|---|---|
| 3,946,398 | 3/1976 | Kyser et al. | 346/1 |
| 4,189,734 | 2/1980 | Kyser et al. | 347/70 |
| 4,393,384 | 7/1983 | Kyser | 346/1.1 |
| 4,463,359 | 7/1984 | Ayata et al. | 346/1.1 |
| 4,499,479 | 2/1985 | Chee-Shuen Lee et al. | 346/140 |
| 4,521,786 | 6/1985 | Bain | 346/140 |
| 4,562,445 | 12/1985 | Rich | 346/140 |
| 4,639,735 | 1/1987 | Yamamoto et al. | 346/1.1 |
| 4,746,935 | 5/1988 | Allen | 346/140 |
| 5,124,716 | 6/1992 | Roy et al. | 346/1.1 |
| 5,202,659 | 4/1993 | DeBonte et al. | 346/1.1 |
| 5,389,958 | 2/1995 | Bui et al. | 347/103 |
| 5,642,142 | 6/1997 | Bohorquez | 347/1.5 |
| 5,677,718 | 10/1997 | Crawford et al. | 347/92 |
| 5,689,291 | 11/1997 | Tence et al. | 347/10 |
| 5,736,993 * | 4/1998 | Regimbal et al. | 347/11 |
| 5,790,139 | 8/1998 | Umeno et al. | 347/10 |
| 5,980,015 * | 11/1999 | Saruta | 347/15 |
| 6,059,393 * | 5/2000 | Takahashi | 347/41 |
| 6,257,689 * | 7/2001 | Yonekubo | 347/11 |

FOREIGN PATENT DOCUMENTS

| | | | |
|---|---|---|---|
| 0 8127 838 * | 3/1998 | (EP) | B41J/2/21 |

* cited by examiner

*Primary Examiner*—John Barlow
*Assistant Examiner*—Alfred E Dudding
(74) *Attorney, Agent, or Firm*—Philip T. Virga

(57) ABSTRACT

An apparatus and method provide on-demand drop volume modulation by utilizing a single transducer driving waveform to drive an ink jet. The driving waveform includes at least a first portion and a second portion that each excites a different modal resonance of ink in an ink jet orifice to produce ink drops having different volumes. A control signal is applied to the driving waveform to actuate the selected portion of the waveform to eject the desired ink drop volume for a given pixel. The control signal also cancels the non-selected portion(s) of the waveform to avoid extraneous excitation of the transducer.

24 Claims, 5 Drawing Sheets

VOLTAGE
TIME (μSEC)
100
110
112
114
116
118
120
122
124
126
130
150
152
154

APPARATUS AND METHOD FOR DROP SIZE MODULATED INK JET PRINTING

FIELD OF INVENTION

This invention relates generally to an apparatus and method for improving resolution in gray scale printing and, more specifically, to an apparatus and method for modulated drop volume ink jet printing that utilizes a single driving waveform to produce on-demand multiple ink drop sizes from a single orifice.

BACKGROUND OF THE INVENTION

Prior drop-on-demand ink jet print heads typically eject ink drops of a single volume that produce on a print medium dots of ink sized to provide printing at a given resolution, such as 12 dots per millimeter (300 dots per inch (dpi)). Single dot size printing is acceptable for most text and graphics printing applications that do not require high image quality. Higher image quality, such as "photographic" image quality, normally requires higher resolution, which slows the print speed. Image quality may also be improved by adding ink color densities, which undesirably requires an increase in the number of jets in the print head.

Another technique for improving image quality is to modulate the reflectance, or gray scale, of the dots forming the image. In single dot size printing, the average reflectance of an image portion is typically modulated by a process referred to as "dithering." In a dithering process the perceived intensity of an array of dots is modulated by selectively printing the array at a predetermined dot density. For example, if a 50 percent local average reflectance is desired, half of the dots in the array are printed. A "checker-board" pattern provides the most uniform appearing 50 percent local average reflectance. Multiple dither pattern dot densities are possible to provide a wide range of reflectance levels.

However, dithering necessitates a trade off between the number of possible reflectance levels and the dot array area required to achieve those levels. Eight-by-eight dot array dithering in a printer having 12 dot per millimeter resolution results in an effective gray scale resolution as low as 3 dots per millimeter (75 dots per inch). Gray scale images printed with such dither array patterns often appear grainy and suffer from poor image quality, especially in areas having a low optical density.

One approach to improving the quality of gray scale images printed with dithering is ink dot size modulation, also referred to as drop volume and drop mass modulation. Ink drop volume modulation entails controlling the volume of each drop of ink ejected by the ink jet print head. Drop volume modulation advantageously provides greater effective printing resolution without sacrificing print speed. For example, an image printed with two dot sizes at 12 dots per millimeter (300 dots per inch) resolution may have a better appearance than the same image printed with one dot size at 24 dots per millimeter (600 dots per inch) resolution. This increase in effective resolution is possible because using two or more dot sizes in low optical density areas increases the dot density (dots/area), which in turn decreases graininess.

There are previously known apparatus and methods for modulating the volume of ink drops ejected from an ink jet print head. U.S. Pat. No. 3,946,398 for a METHOD AND APPARATUS FOR RECORDING WITH WRITING FLUIDS AND DROP PROJECTION MEANS THEREFORE describes a variable drop volume drop-on-demand ink jet head that ejects ink drops in response to pressure pulses developed in an ink pressure chamber by a piezoelectric transducer (hereafter referred to as a "PZT"). Drop volume modulation entails varying an amount of electrical waveform energy applied to the PZT for the generation of each pressure pulse. However, it is noted that varying the drop volume may also vary the drop ejection velocity and result in drop landing position errors. Constant drop volume, therefore, is taught as a way of maintaining image quality. The drop ejection rate is also limited to about 3000 drops per second (3 kHz), a rate that is slow compared to typical printing speed requirements.

U.S. Pat. No. 5,124,716 for a METHOD AND APPARATUS FOR PRINTING WITH INK DROPS OF VARYING SIZES USING A DROP-ON-DEMAND INK JET PRINT HEAD, assigned to the assignee of the present invention, and U.S. Pat. No. 4,639,735 for APPARATUS FOR DRIVING LIQUID JET HEAD describe circuits and PZT drive waveforms suitable for ejecting ink drops smaller than an ink jet orifice diameter. However, a separate drive waveform must be generated and applied to the PZT for each different drop size. The waveform generating componentry required to produce the multiple waveforms is undesirably complex and adds additional cost to the printer.

Another approach to modulating drop volume is disclosed in U.S. Pat. No. 4,746,935 for a MULTITONE INK JET PRINTER AND METHOD OF OPERATION. This describes an ink jet print head having multiple orifice sizes, each optimized to eject a particular drop volume. Of course, such a print head is significantly more complex than a single size orifice print head and still requires a very small orifice to produce the smallest drop volume.

U.S. Patent No. 5,689,291 for a METHOD AND APPARATUS FOR PRODUCING DOT SIZE MODULATED INK JET PRINTING, assigned to the assignee of the present application, provides multiple PZT drive waveforms for producing various ink drop volumes. The various ejected ink drop volumes have substantially the same ejection velocity over a range of drop ejection repetition rates. As with other previous systems, a different drive waveform must be generated and applied to the PZT for each drop volume desired.

What is needed, therefore, is a simple and inexpensive ink jet print head system that provides high-resolution drop volume modulation without requiring multiple drive waveforms and the associated generation and control componentry, and without sacrificing print speed. This need is met by the apparatus and method of the present invention.

SUMMARY OF THE INVENTION

It is an aspect of the present invention to provide a simple and inexpensive ink jet printing apparatus and method for improving resolution in gray scale printing without compromising print speed.

It is another aspect of the present invention to provide an ink jet printing apparatus and method for increasing ink drop density for a given image optical density.

It is yet another aspect of the present invention to provide an ink jet printing apparatus and method that are capable of on-demand selection of multiple volumetric ink drop sizes for a given pixel on a receiving surface.

It is a feature of the present invention to provide an ink jet printing apparatus and method that utilize two or more ink drop volumes to improve ink drop density and thereby decrease image graininess in low optical density areas.

It is another feature of the present invention that two or more ink drop volumes are generated from a single driving waveform.

It is still another feature of the present invention that a control signal is utilized to manipulate the driving waveform to eject the desired ink drop volume for a given pixel.

It is yet another feature of the present invention to provide a high resolution gray scale ink jet printing apparatus and method that utilizes drop volume modulation without requiring extensive waveform generating and control componentry or multiple jet and/or orifice sizes.

It is an advantage of the present invention that the apparatus and method perform on-demand selection of two or more drop volumes for a given pixel without sacrificing print speed.

It is another advantage of the present invention that a single set of waveform generating and control components is utilized to achieve on-demand multiple drop volume printing.

To achieve the foregoing and other aspects, features and advantages, and in accordance with the purposes of the present invention as described herein, an apparatus and method provide on-demand drop volume modulation by utilizing a single transducer drive waveform. The drive waveform includes at least a first portion and a second portion that each excites a different modal resonance of ink in an ink jet orifice to produce ink drops having different volumes. A control signal is applied to the drive waveform to actuate the selected portion of the waveform to eject the desired ink drop volume for a given pixel location. The control signal also cancels the non-selected portion(s) of the waveform to avoid extraneous excitation of the transducer.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

DETAILED DESCRIPTION OF THE PREFERRED EMBODIMENT

Figure 1:
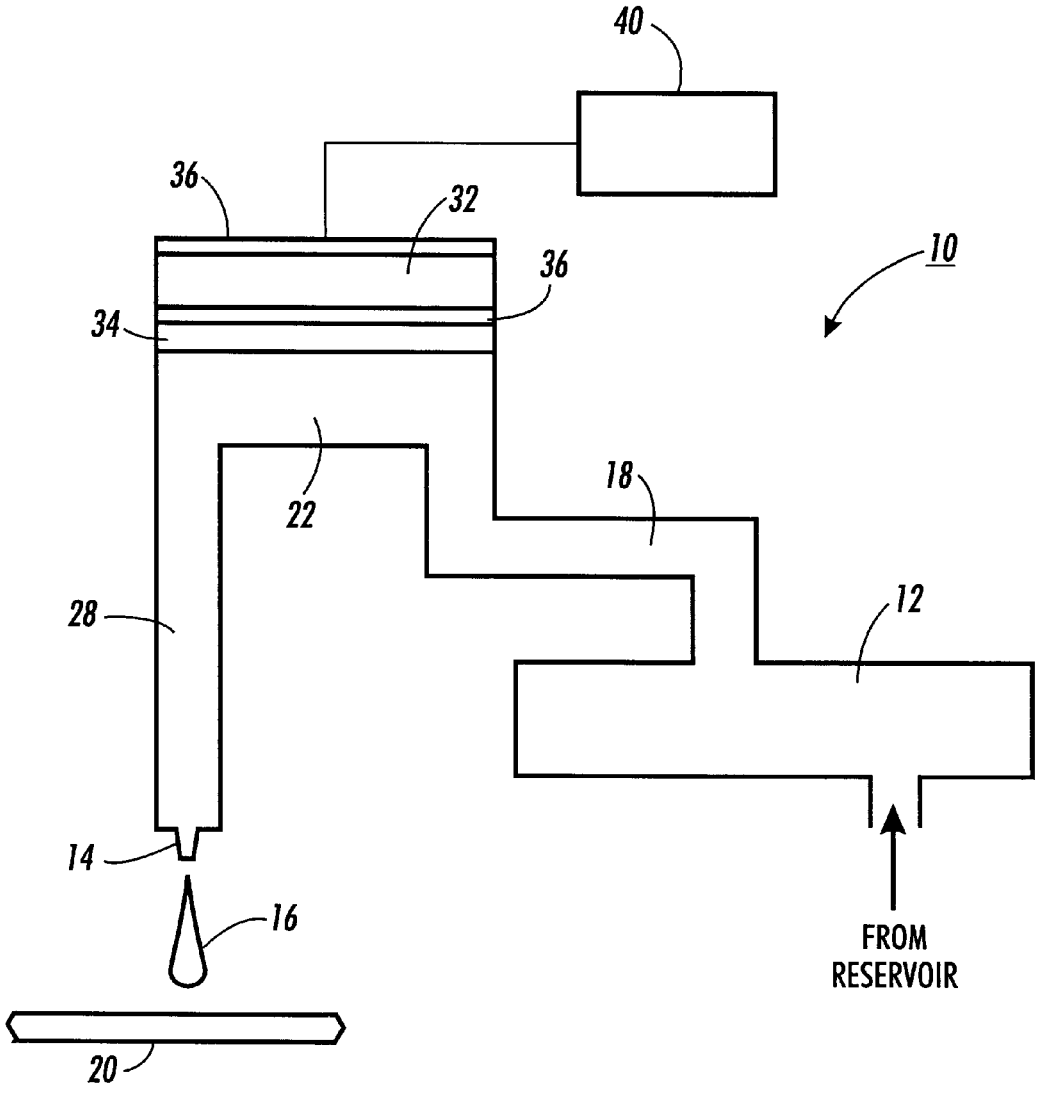
FIG. 1 is an enlarged schematic view of a preferred PZT driven ink jet suitable for use with this invention.

FIG. 1 shows a schematic view of an individual ink jet 10 according to the present invention. The ink jet 10 is a part of a multiple-orifice ink jet print head suitable for use with this invention. Ink jet 10 includes an ink manifold 12 that receives ink from a reservoir (not shown). Ink flows from manifold 12 through an inlet channel 18 into an ink pressure chamber 22. Ink flows from the pressure chamber 22 into an outlet channel 28 to the ink drop forming orifice 14, from which an ink drop 16 is ejected toward a receiving surface 20.

A typical ink jet print head includes an array of orifices that are closely spaced from one another for use in ejecting drops of ink toward a receiving surface. The typical print head also has at least four manifolds for receiving black, cyan, magenta and yellow ink for use in monochrome plus subtractive color printing. However, the number of such manifolds may be varied where a printer is designed to print solely in black ink, gray scale or with less than a full range of color.

Returning to the ink jet 10 of FIG. 1, ink pressure chamber 22 is bounded on one side by a flexible diaphragm 34. An electro mechanical transducer 32, such as a piezoelectric transducer (PZT), is secured to diaphragm 34 by an appropriate adhesive and overlays ink pressure chamber 22. The transducer mechanism 32 can comprise a ceramic transducer bonded with epoxy to the diaphragm plate 34, with the transducer centered over the ink pressure chamber 22. The transducer may be substantially rectangular in shape, or alternatively, may be substantially circular or disc-shaped. In a conventional manner, transducer 32 has metal film layers 36 to which an electronic transducer driver 40 is electrically connected. The preferred transducer 32 is a bending mode transducer. It will be appreciated that other types and forms of transducers may also be used, such as shear-mode, annular constrictive, electrostrictive, electromagnetic or magnetostrictive transducers.

Transducer 32 is operated in its bending mode such that when a voltage is applied across metal film layers 34, transducer 32 attempts to change its dimensions. Because it is securely and rigidly attached to diaphragm 34, transducer 32 bends and deforms diaphragm 34, thereby displacing ink in ink pressure chamber 22 and causing the outward flow of ink through outlet channel 28 to nozzle 14. Refill of ink pressure chamber 22 following the ejection of an ink drop is accomplished by reverse bending of transducer 32 and the resulting movement of diaphragm 34.

Ink jet 10 may be formed from multiple laminated plates or sheets, such as sheets of stainless steel, that are stacked in a superimposed relationship. An example of a multiple-plate ink jet is disclosed in U.S. Pat. No. 5,689,291 entitled METHOD AND APPARATUS FOR PRODUCING DOT SIZE MODULATED INK JET PRINTING, and assigned to the assignee of the present application. U.S. Pat. No. 5,689,291 is specifically incorporated by reference in pertinent part. It will be appreciated that various numbers and combinations of plates may be utilized to form the ink jet 10 and its individual components and features. Persons skilled in the art will also recognize that other modifications and additional features may be utilized with this type of ink jet to achieve a desired level of performance and/or reliability. For example, acoustic filters may be incorporated into the ink jet to dampen extraneous and potentially harmful pressure waves. The positioning of the manifolds, pressure chambers and inlet and outlet channels in the print head may also be modified to control ink jet performance.

To eject an ink drop from an ink jet such as that of FIG. 1, a driving waveform is provided to transducer 32 from a transducer driver 40. Transducer 32 responds to the driving waveform by inducing pressure waves in the ink that excite ink fluid flow resonances in orifice 14 and at the ink surface meniscus. The particular resonance mode excited by the waveform determines the drop volume ejected.

Designing drive waveforms suitable for ejecting a desired drop volume generally involves concentrating energy at frequencies near the natural frequency of a desired mode, and suppressing energy at the natural frequencies of other modes. Extraneous and parasitic resonant frequencies that compete for energy with the desired mode should also be controlled. A more detailed discussion of designing drive waveforms is found in the earlier referenced and incorporated U.S. Pat. No. 5,689,291.

Figures 2A, 2B:
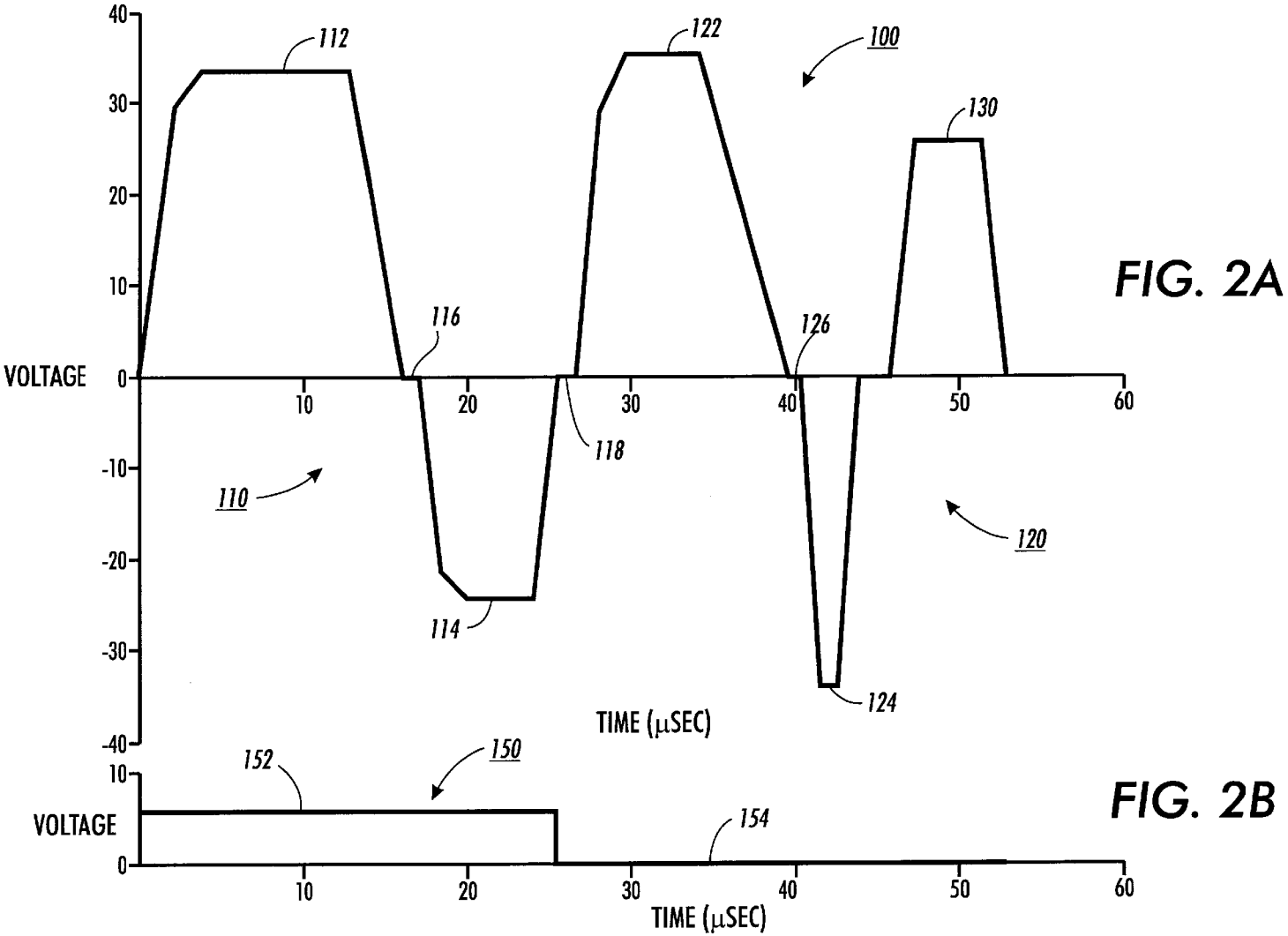
FIG. 2*a* is a graphical waveform diagram showing the electrical voltage and timing of a preferred transducer driving waveform.
FIG. 2*b* is a graphical waveform diagram plotted over the same time sequence as FIG. 2*a* showing the electrical voltage and timing of a preferred control signal waveform used to actuate a desired portion of the driving waveform.
Figure 3:
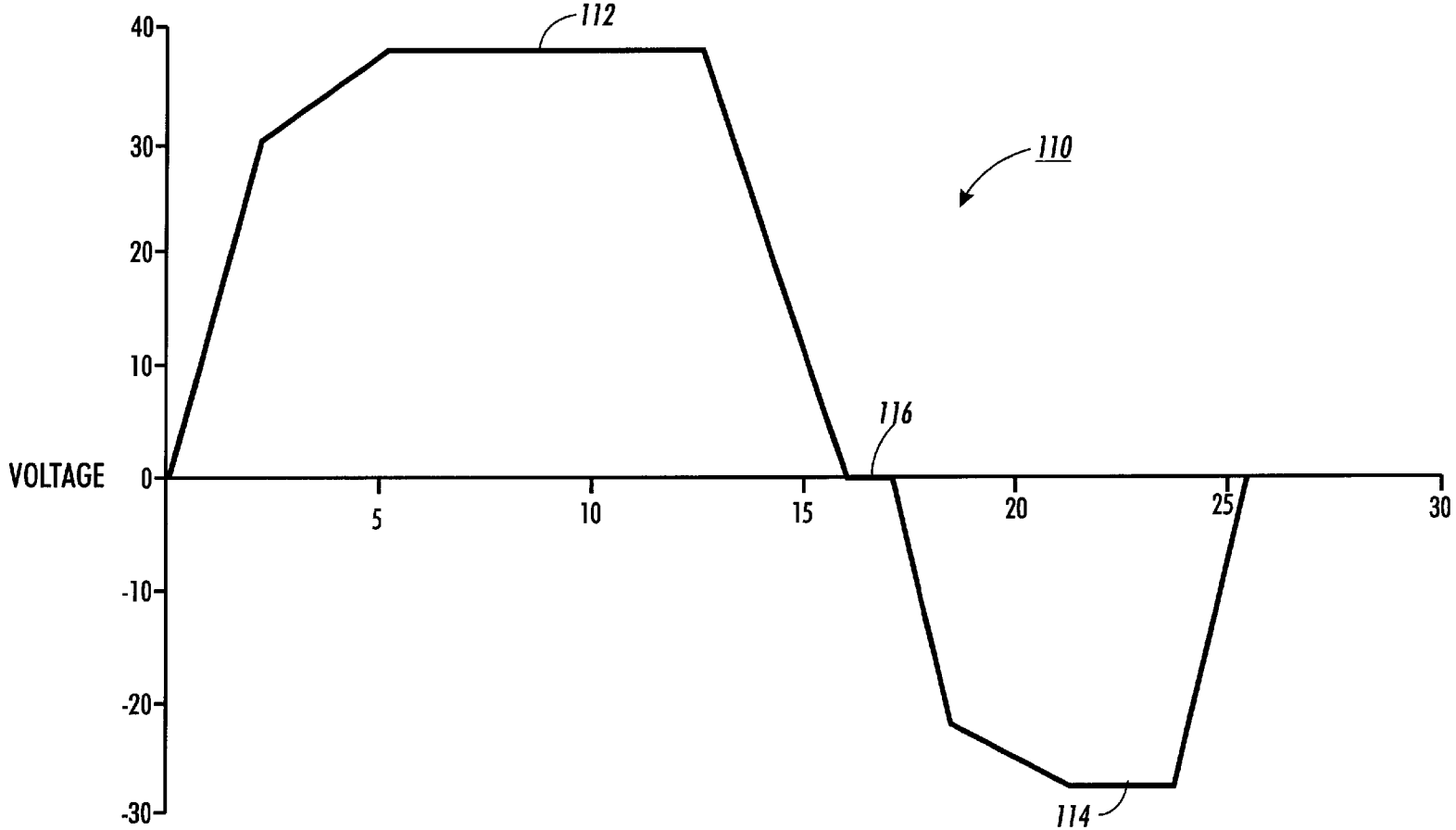
FIG. 3 is a graphical waveform diagram illustrating a first portion of the driving waveform of FIG. 2*a*.

As discussed earlier, prior ink jet systems capable of producing multiple ink drop volumes from a single orifice have required separate and distinct driving waveforms for each drop volume desired. Advantageously, and in an important aspect of the present invention, the method and apparatus described herein utilize a single driving waveform that includes multiple portions for producing ink drops having multiple volumes. With reference now to FIG. 2*a*, a preferred embodiment of the driving waveform of the present invention will now be described. The driving waveform 100 includes a first bi-polar portion 110 and a second bi-polar portion 120 that includes two positive pulses. With reference now to FIG. 3, the first portion 110 of the driving waveform 100 includes a plus 35 volt, 16 microsecond pulse component 112 and a negative 26 volt, 9 microsecond pulse component 114 separated by a 1 microsecond wait period 116.

Figure 4:
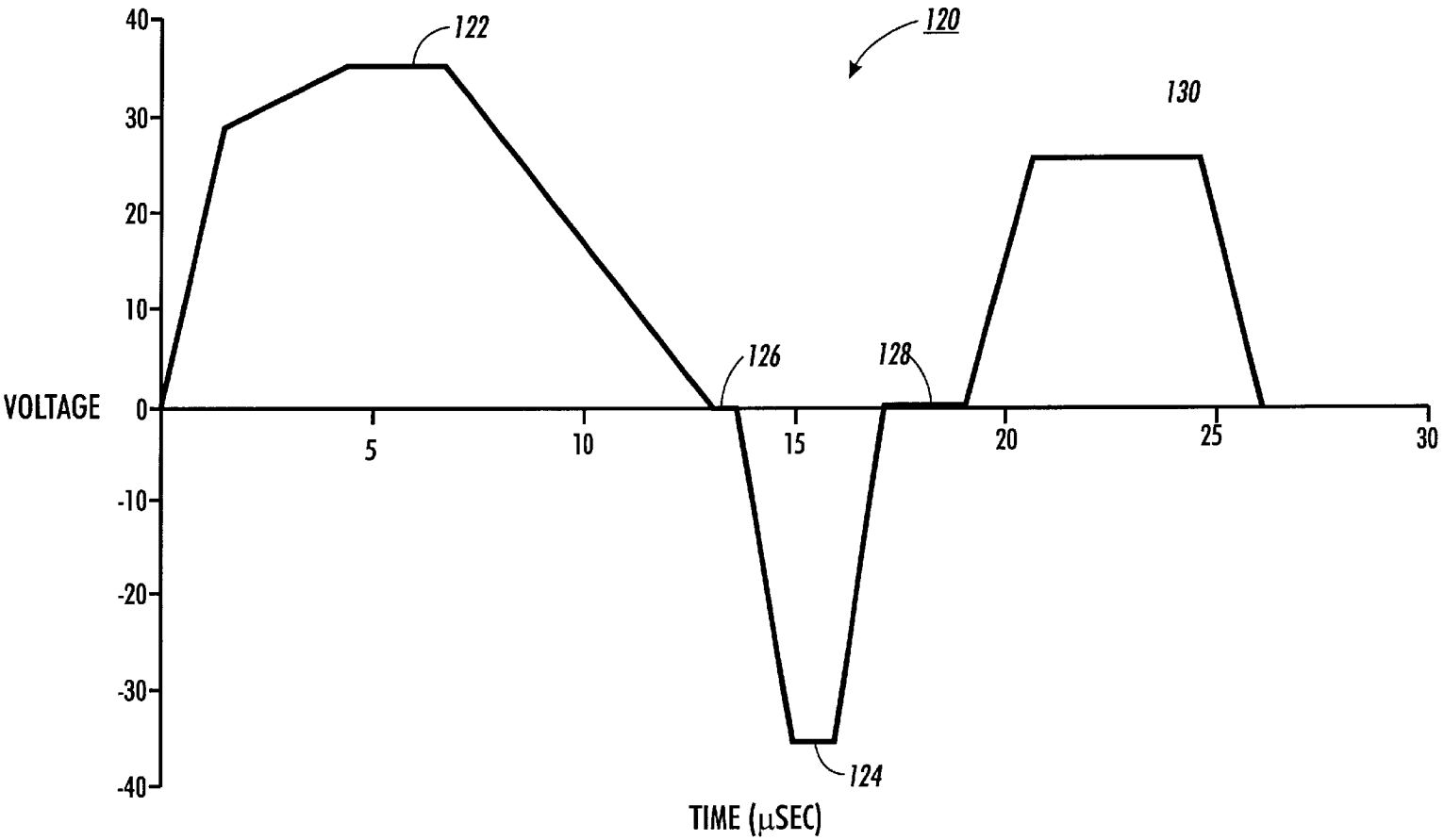
FIG. 4 is a graphical waveform diagram illustrating a second portion of the driving waveform of FIG. 2*a*.

With reference again to FIG. 2*a*, the second portion 120 of the driving waveform follows the first portion 110 after a 1 microsecond wait period 118. With reference now to FIG. 4, a preferred embodiment of the second portion waveform 120 is illustrated. The second portion waveform 120 includes a plus 35 volt, 13 microsecond pulse component 122 and a negative 35 volt, 4 microsecond pulse component 124 separated by a 0.5 microsecond wait period 126. Following the negative pulse component 124 and a 2 microsecond wait period 128 is a second positive voltage pulse comprising a plus 26 volt, 7 microsecond pulse component 130.

The first and second portions 110, 120 of the driving waveform 100 are each designed to generate ink drops having a different volume. For example, when utilized with an ink jet of the type shown in FIG. 1, the first portion waveform 110 generates an ink drop having a volume of approximately 58 picoliters, and the second portion waveform 120 generates an ink drop having a volume of approximately 27 picoliters.

To select a desired drop size for a given pixel, and in another important aspect of the present invention, a control signal is applied to the driving waveform 100 to enable the desired portion of the driving waveform to actuate the transducer and eject a fluid drop having a desired volume. Advantageously, this combination of a single, multiple drop size driving waveform and control signal allows for pixel-by-pixel, on-demand selection of multiple ink drop sizes. For example, in an offset ink jet printing architecture utilizing a rotating receiving surface and a translating print head, the print head may eject mulitple ink drop volumes during a single rotation of the receiving surface. Additionally, output containing multiple ink drop sizes may be created on a receiving surface at a constant speed.

With reference now to FIG. 2*b*, in the preferred embodiment the control signal 150 is a substantially rectangular waveform that includes an actuation component 152 having a positive voltage and a cancellation component 154 having a zero voltage. Preferably, the actuation component 152 is a 5 volt pulse having a duration substantially equal to the driving waveform portion being actuated. The cancellation component 154 is a 0 volt flat line having a duration substantially equal to the driving waveform portion not selected. As an example, FIGS. 2*a* and 2*b* graphically illustrate the actuation of the first portion 110 of the driving waveform 100 and the cancellation of the second portion 120 of the waveform, thereby producing a 58 picoliter ink drop. In the case where the second portion 120 of the driving waveform 100 is selected, the actuation component 152 of the control signal 150 is applied to correspond to the second portion 120 of the waveform, and the cancellation component 154 corresponds to the first portion 110. In this manner, the control signal enables the desired portion of the driving waveform and cancels the non-selected portion to eject the desired volume ink drop for a given pixel. It will also be appreciated that the entire control signal 150 will be a 0 volt flat line that cancels the entire driving waveform 100 when no ink drop is desired for a given pixel.

Figure 5:
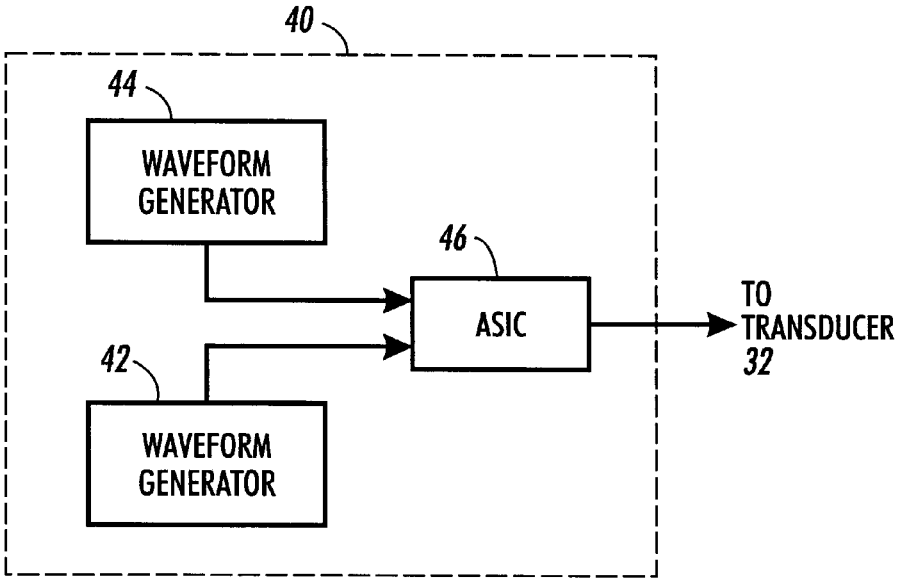
FIG. 5 is a schematic block diagram of apparatus used to generate the transducer driving waveform and control signal of FIGS. 2*a* and 2*b*.

FIG. 5 schematically illustrates apparatus representative of the transducer driver 40 (see FIG. 1) that is suitable for generating the driving waveform 100 and the control signal 150. The transducer driver 40 includes an image loader 42 that generates the control signal 150 and a waveform generator 44 that generates the driving waveform 100. Any suitable commercial waveform generator may be utilized, such as an A.W.G. 2005 waveform generator, manufactured by Tektronix, Inc., the assignee of the present application. The waveform generator 44 and image loader 42 are electrically connected to an ASIC 46 that provides an output signal suitable for driving the metal film layers 34 of the transducer 32. The image loader 42 determines ink drop volume by generating the control signal 150 to selectively enable either the first portion 110, the second portion 120 or neither portion of the driving waveform 100 to actuate the transducer 32 for each pixel in a bit map image.

Depending upon the printing speed desired, the waveform generator 44 generates the driving waveform 100 and the image loader 42 generates the control signal 150 at a frequency that ejects fluid drops at a rate of between about 10,000 drops per second to about 50,000 drops per second, and more preferably at a rate of about 18,000 drops per second. Advantageously, the use of a single, multiple drop size driving waveform and control signal requires only one set of waveform generating and control components, thereby simplifying and reducing the cost of an ink jet printer utilizing the present invention.

The present method and apparatus for on-demand drop size modulation are most advantageously utilized to print low optical density images or areas. As explained above, lower optical density images generally require a higher degree of dithering, which often results in grainy images when a single drop size is used. Using smaller drops in low optical density regions through drop size switching advantageously decreases graininess by increasing dot density in these regions.

Dot position in low optical density areas is less critical than in other areas that utilize less dithering. Therefore, the preferred driving waveform portions 110 and 120 are optimized to eject an ink drop at substantially the same velocity to give a substantially equal transit time for drop travel to the receiving surface independent of drop size. Alternatively, where greater precision in dot position is desired, the second portion waveform 120 may be designed to eject an ink drop with a higher velocity than an ink drop ejected by the first portion waveform 110. The difference in velocities may be optimized to overcome the time delay between the second portion waveform 120 and the first portion 110 to thereby improve dot position accuracy.

Figure 6:
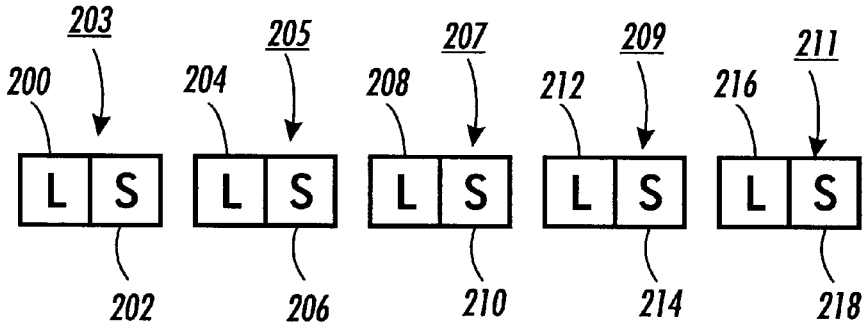
FIG. 6 is a schematic diagram showing five consecutive pixels with each pixel containing two potential drop locations.

As referenced above, the preferred maximum firing rate of the present invention is approximately 18,000 drops per second, or 18 kHz. To optimize the reliability of the ink jet and preserve individual drop integrity, different maximum firing rates may be utilized when switching between drop sizes. FIG. 6 diagrammatically illustrates five consecutive 400 dpi pixels 203, 205, 207, 209 and 211 that each include two potential drop locations L and S. Each drop location L corresponds to a "large" ink drop of a desired volume that is generated by the first portion 110 of the driving waveform 100. Each potential drop location S corresponds to a "small" ink drop of a desired volume that is generated by the second portion 120 of the driving waveform. It will be appreciated that each pixel in FIG. 6 is addressed by one cycle of the driving waveform 100.

Where the same size drops, whether large or small, are desired for consecutive pixels, an ink drop may be ejected onto each pixel at the full, preferred maximum firing rate of 18 kHz. For example, where consecutive large drops 200, 204 and 208 are desired, three consecutive cycles of the first portion 110 of the driving waveform 100 may be actuated by the control signal. In the preferred embodiment, when the desired drop size is switched from large to small or small to large, the firing rate is reduced by skipping one complete cycle of the driving waveform 100 between the ejection of different sized drops. This insures that the desired maximum firing rate is not exceeded when switching drop sizes. For example, if a large drop were ejected onto potential drop location 200 and a small drop onto potential drop location 202 in the same pixel 203, this would require an effective firing rate of 36 kHz.

With reference again to FIG. 6, switching from a small drop to a large drop entails skipping two potential drop locations or one complete pixel. For example, where a small drop is printed in potential drop location 202 in pixel 203 and a large drop is desired next, potential drop locations 204 and 206 are skipped and a large drop is ejected onto potential drop location 208 in pixel 207. Assuming a maximum firing rate of 18 kHz, this increase in drop volume from a small drop to a large drop allows a maximum firing rate of 12 kHz. When switching from a large drop to a small drop, four potential drop locations are skipped in order to skip one complete cycle of the driving waveform 100. For example, where a large drop is printed in potential drop location 204 in pixel 205, potential drop locations 206, 208, 210 and 212 are skipped before a small drop is ejected onto potential drop location 214 in pixel 209. With a given maximum firing rate of 18 kHz, switching from a large drop to a small drop allows a maximum firing rate of 7.2 kHz.

It will be appreciated that maximum drop ejection rates exceeding 18 kHz are possible using a more optimized ink jet design. Such an ink jet design will eliminate internal resonant frequencies close to those required to excite orifice resonance modes needed for drop volume modulation. Additionally, adjusted drop ejection rates exceeding those referenced above for drop size switching are possible with an optimized ink jet design.

An ink jet printer according to the present invention includes a print head having multiple ink jets 10 as described above. Examples of an ink jet print head and an ink jet printer architecture are disclosed in U.S. Pat. No. 5,677,718 entitled DROP-ON-DEMAND INK JET PRINT HEAD HAVING IMPROVED PURGING PERFORMANCE and U.S. Pat. No. 5,389,958 entitled IMAGING PROCESS, both patents assigned to the assignee of the present application. U.S. Pat. Nos. 5,677,718 and 5,389,958 are specifically incorporated by reference in pertinent part. It will be appreciated that other ink jet print head constructions and ink jet printer architectures may be utilized in practicing the present invention.

The method and apparatus of the present invention may be practiced to jet various fluid types including, but not limited to, aqueous and phase-change inks of various colors. Likewise, skilled workers will recognize that other driving waveforms having various ink drop forming portions may be utilized. For example, where three or more different drop volumes are desired, the driving waveform may be designed to include a corresponding number of waveform portions to jet each desired ink drop volume. Additionally, in an alternative embodiment of the preferred driving waveform 100, the second portion waveform 120 may precede the first portion waveform 110 in each cycle. It will also be noted that this invention is useful in combination with various prior art techniques including dithering and electric field drop acceleration to provide enhanced image quality and drop landing accuracy. The present invention is amenable to any fluid jetting drive mechanism and architecture capable of providing the required drive waveform energy distribution to a suitable orifice and its fluid meniscus surface.

It will be obvious to those having skill in the art that many other changes may be made to the details of the above-described embodiments of this invention without departing from the underlying principles thereof. For example, although described in terms of electrical energy waveforms to drive the transducers, any other suitable energy form could be used to actuate the transducer including, but not limited to, acoustical or microwave energy. Accordingly, it will be appreciated that this invention is applicable to fluid drop size modulation applications other than those found in ink jet printers.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all changes, modifications and variations that may occur to one of skill in the art upon a reading of the disclosure. All patents cited herein are incorporated by reference in their entirety.

What is claimed is:

1. An apparatus for ejecting fluid drops from an orifice, the apparatus comprising:

a pressure chamber in fluid communication with the orifice;

a transducer coupled to the pressure chamber;

a driving waveform applied to the transducer, the driving waveform having at least a first portion and a second portion wherein the second portion of the driving waveform includes at least two positive pulses separated by a negative pulse; and a control signal applied to the driving waveform, the control signal including an actuation component that enables either the first portion of the driving waveform or the second portion of the driving waveform to actuate the transducer to eject a fluid drop.

2. The apparatus for ejecting fluid drops from an orifice of an ink jet printer of claim 1, wherein the actuation component of the control signal comprises a pulse corresponding to either the first portion of the driving waveform or the second portion of the driving waveform.

3. The apparatus for ejecting fluid drops from an orifice of an ink jet printer of claim 2, wherein the control signal further includes a cancellation component that cancels the first portion of the driving waveform if the second portion of the driving waveform is enabled, or cancels the second portion of the driving waveform if the first portion of the driving waveform is enabled.

4. The apparatus for ejecting fluid drops from an orifice of an ink jet printer of claim 3, wherein the cancellation component of the control signal corresponds to the first portion of the driving waveform if the second portion of the driving waveform is enabled, or corresponds to the second portion of the driving waveform if the first portion of the driving waveform is enabled.

5. The apparatus for ejecting fluid drops from an orifice of an ink jet printer of claim 4, wherein the control signal comprises a substantially rectangular waveform.

6. The apparatus for ejecting fluid drops from an orifice of an ink jet printer of claim 5, wherein the first portion of the driving waveform actuates the transducer to eject a first drop having a first volume, and the second portion of the driving waveform ejects a second drop having a second volume that is different from the first volume.

7. The apparatus for ejecting fluid drops from an orifice of an ink jet printer of claim 6, wherein the second volume is less than the first volume.

8. The apparatus for ejecting fluid drops from an orifice of an ink jet printer of claim 1, wherein the first portion of the driving waveform comprises a bipolar waveform.

9. The apparatus for ejecting fluid drops from an orifice of an ink jet printer of claim 8, wherein the first portion of the driving waveform includes a positive pulse having an amplitude of between about 25 Volts and about 45 Volts.

10. The apparatus for ejecting fluid drops from an orifice of an ink jet printer of claim 9, wherein the first portion of the driving waveform includes a negative pulse having an amplitude of between about −15 Volts and about −35 Volts.

11. The apparatus for ejecting fluid drops from an orifice of an ink jet printer of claim 10, wherein the first portion of the driving waveform has a duration of between about 20 microseconds and about 35 microseconds.

12. The apparatus for ejecting fluid drops from an orifice of an ink jet printer of claim 1, wherein the two positive pulses have an amplitude of between about 15 Volts and about 45 Volts.

13. The apparatus for ejecting fluid drops from an orifice of an ink jet printer of claim 1, wherein the negative pulse has an amplitude of between about −25 Volts and about −45 Volts.

14. A method of ejecting a plurality of ink drops from an orifice of an ink jet printer to a plurality of pixels, the method comprising the steps of:

providing a pressure chamber in fluid communication with the orifice;

coupling a transducer to the pressure chamber;

generating a transducer driving waveform comprising at least a first portion and a second portion;

selecting for a given pixel to eject either a first drop having a first volume or a second drop having a second volume different from the first volume;

if the first drop is selected for the given pixel, applying the first portion of the driving waveform to the transducer to eject the first drop;

if the second drop is selected for the given pixel, applying the second portion of the driving waveform to the transducer to eject the second drop; and skipping at least one cycle of the driving waveform between the step of ejecting the first drop and the step of ejecting the second drop.

15. The method of claim 14, wherein the step of applying the first portion of the driving waveform to the transducer further includes the step of canceling the second portion of the driving waveform.

16. The method of claim 15, wherein the step of applying the second portion of the driving waveform to the transducer further includes the step of canceling the first portion of the driving waveform.

17. The method of claim 16, further including the steps of:

generating a control signal;

if the first drop is selected for the given pixel, applying the control signal to the driving waveform to transmit the first portion of the driving waveform to the transducer and to cancel the second portion of the driving waveform; and if the second drop is selected for the given pixel, applying the control signal to the driving waveform to transmit the second portion of the driving waveform to the transducer and to cancel the first portion of the driving waveform.

18. The method of claim 17, further including the step of ejecting the first drop and ejecting the second drop at substantially the same ejection velocity.

19. The method of claim 14, further including the steps of:

defining each pixel to include two potential drop locations;

ejecting the first drop onto a first potential drop location;

skipping four potential drop locations; and ejecting the second drop onto a second potential drop location.

20. The method of claim 14, further including the steps of:

ejecting the second drop onto a third potential drop location;

skipping two potential drop locations; and ejecting the first drop onto a fourth potential drop location.

21. The method of claim 14, further including the steps of:

defining each pixel to include a first potential drop location corresponding to the first drop and a second potential drop location corresponding to the second drop;

ejecting the first drop onto a first potential drop location in a first pixel;

skipping a second pixel; and ejecting the second drop onto a second potential drop location in a third pixel.

22. The method of claim 21, further including the steps of:

ejecting the second drop onto a second potential drop location in a fourth pixel;

skipping a fifth pixel; and ejecting the first drop onto a first potential drop location in a sixth pixel.

23. The method of claim 22, further including the step of ejecting the second drop at a higher velocity than the first drop.

24. The method of claim 23, further including the step of creating output on a receiving surface at a constant speed.

* * * * *